US006017270A

United States Patent [19]

Ristvedt et al.

[11] Patent Number: 6,017,270

[45] Date of Patent: Jan. 25, 2000

[54] COIN SORTER

[76] Inventors: Victor G. Ristvedt, 70 Forestwood Dr., Manchester, Tenn. 37355; Mark E. Ristvedt, 102 Canterbury Rd., Oak Ridge, Tenn. 37830

[21] Appl. No.: 09/141,953

[22] Filed: Aug. 28, 1998

Related U.S. Application Data

[63] Continuation-in-part of application No. 08/951,681, Oct. 16, 1997

[60] Provisional application No. 60/050,976, Jun. 20, 1997.

[51] Int. Cl.[7] ..... G07D 3/12

[52] U.S. Cl. ..... 453/5; 453/55

[58] Field of Search ..... 453/5, 8, 14, 15, 453/9, 55

[56] References Cited

U.S. PATENT DOCUMENTS

| | | | |
|---|---|---|---|
| 574,528 | 1/1897 | Elder | 453/5 |
| 2,487,163 | 11/1949 | Miconi | 453/9 |
| 4,379,466 | 4/1983 | Furuya | 453/5 |

*Primary Examiner*—F. J. Bartuska
*Attorney, Agent, or Firm*—C. A. Phillips

[57] ABSTRACT

A coin sorter wherein there area plurality of side-by-side V-shaped, elongated tracks. These tracks are on a slope and are fed from a common coin feeder and the tracks are terminated at lower ends by coin diverters varied in configuration to progressively divert, and thus sort coins in a descending order of diameter.

19 Claims, 10 Drawing Sheets

88
94
96
30
90
92
96

C
30
88
90
C 108
6C
112
100
110
108
106
102
6C
98
96
6B
94
88
96
6B
92
6A
90
30
6A
A
92
94
98
104
30
90
104
98
A

COIN SORTER

CROSS-REFERENCE TO RELATED APPLICATION

This application is a continuation-in-part of prior application Ser. No. 08/951,681, filed Oct. 16, 1997, entitled "Coin Sorter" and filed by the same inventors as for the present application, the said prior application in turn claiming the benefit of provisional application Ser. No. 60/050,976 filed Jun. 20, 1997.

FIELD OF THE INVENTION

This invention relates generally to high-speed coin sorting devices, and particularly to a coin sorter wherein mixed coins are distributed into a plurality of troughs each having serially arranged pairs of diverters mounted therein, one diverter pair for each diameter of coin to be sorted, with sorted and counted coins falling through slots in the troughs into collection receptacles.

BACKGROUND OF THE INVENTION

The present invention is a coin sorter which has its roots in a very early type of coin sorter called a "rail" sorter. In this sorter, coins ride downward along a wall and on a lip or rail and are sorted either by an opening or discontinuity in the wall corresponding to the diameter of the of the coin to be sorted or possibly by a diverter which engages coins of the diameter to be sorted.

In accordance with this invention, there is generally the following:

1. A device receives a volume of coins and spreads them out into multiple channels of coin flow.

2. Coins then flow at a moderate angle downward against opposed sides of a plurality of side-by-side troughs, with a vertical member longitudinally bisecting each trough so that two flows of coin are present in each trough.

3. The coins are separated at the foot of the troughs by diverters which move aside first the largest coin, then a second diverter moves the next smaller coin, and then a next smaller diverter separates the next smaller coin, etc. Coins are counted in the area of each diverter as they are sorted.

There is a manifold for receiving each diameter of coin, each manifold supplying coins to a bag or canister by employing two rates of coin flow into the manifolds, and thus a precise counting of coins is achieved.

This invention will be better understood from the following written description when considered in conjunction with the appended drawings.

DETAILED DESCRIPTION OF THE DRAWINGS

Figure 1:
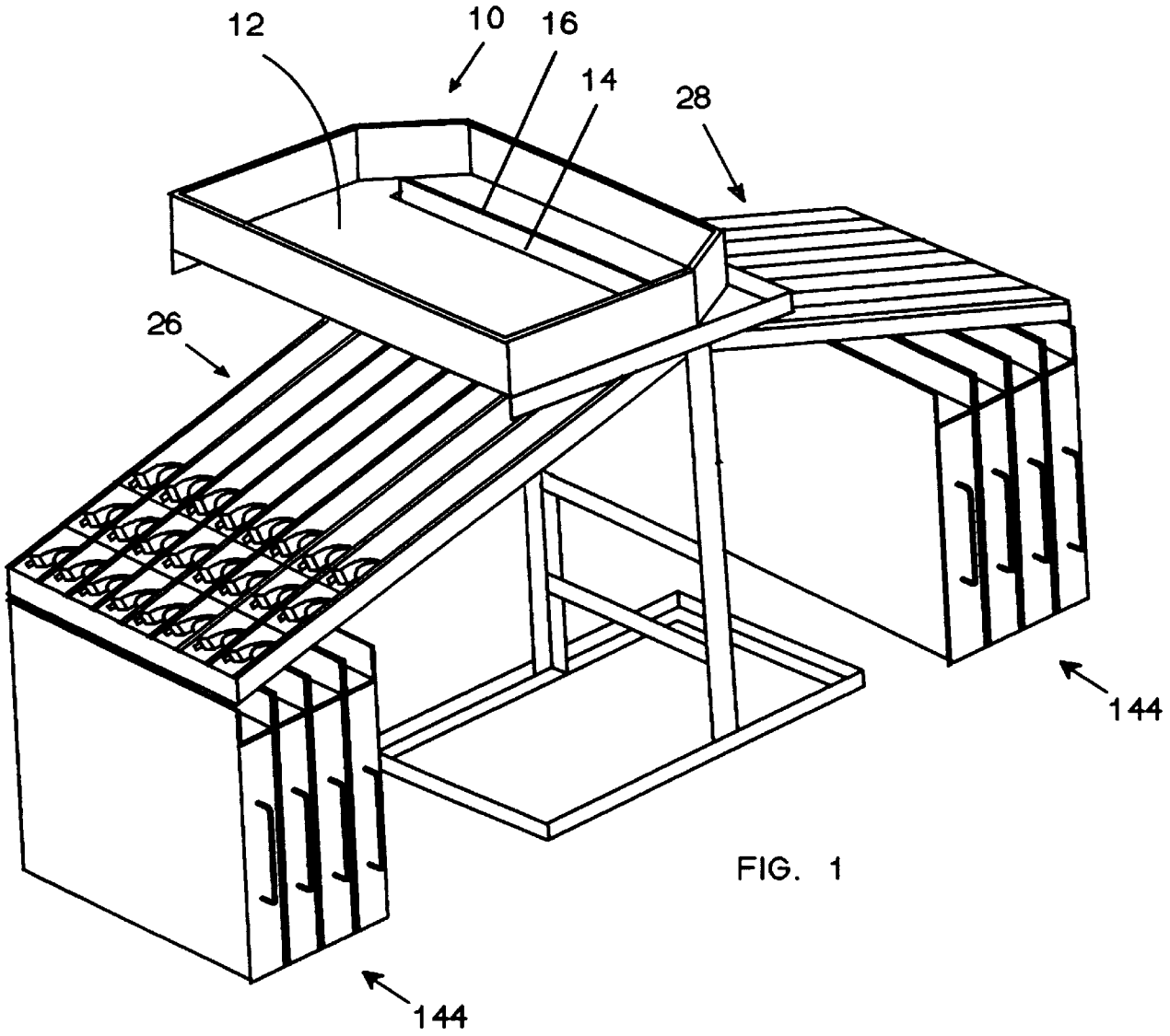
FIG. 1 is a pictorial, diagrammatic illustration of one embodiment of the invention.

Referring to FIG. 1, there is shown a first embodiment of the invention wherein there is a centrally positioned hopper 10 having a floor 12. Coins are deposited on floor 12 and pushed by an operator to a slot 14 through which the coins are fed. A baffle 16 extending upward from a far edge of slot 14 may be used to prevent coins from being pushed past slot 14, or baffle 14 may be omitted. By feeding the coins through a slot, the quantity of coins immediately available to the sorter is limited so that the sorter does not jam or otherwise missort or miscount the coins. Additionally, feeding the coins through a slot assists in spreading the coins out over the full width of the sorter.

Figure 1A:
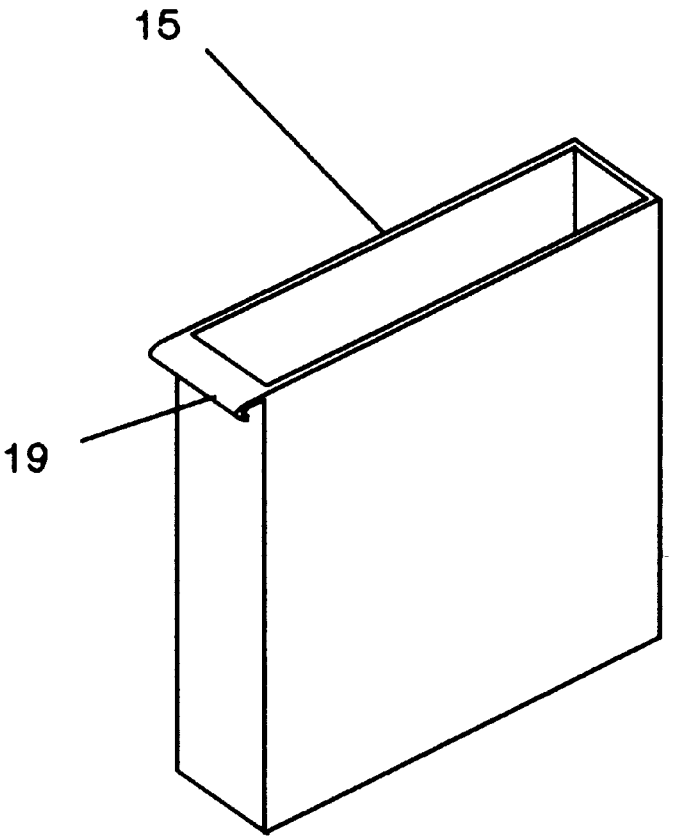
FIGS. 1*a* and 1*b* are side perspective views of coin receiving receptacles showing particular details of the invention.
Figure 1B:
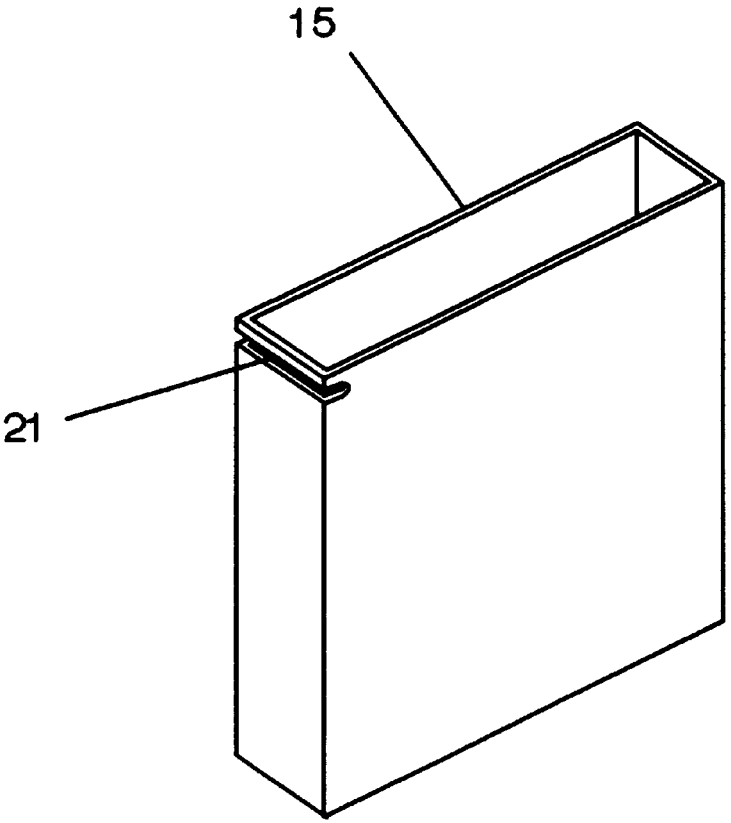

After being sorted, the coins fall into coin receiving or holding receptacle 15 removably mounted beneath the sorting area. As such, these receptacles 15 may basically be rectangular boxes each having a handle 17, and further may be provided with sound proofing material to deaden noise by providing a cushion against which coins impact as they fall into the receptacles. Also, rear upper edges of receptacles 15 may be provided with either a hook 19 or notch 21, as shown in FIGS. 1*a* and 1*b* respectively, for receiving an edge of a coin bag. Here, when emptying a coin receptacle, an upper edge of a coin bag may be held in place by hook 19 or notch 21 and the opening of the coin bag pulled over the opening of the receptacle. The receptacle may then be emptied by simply tilting the receptacle, eliminating the need to lift a heavy coin filled receptacle.

Figure 2:
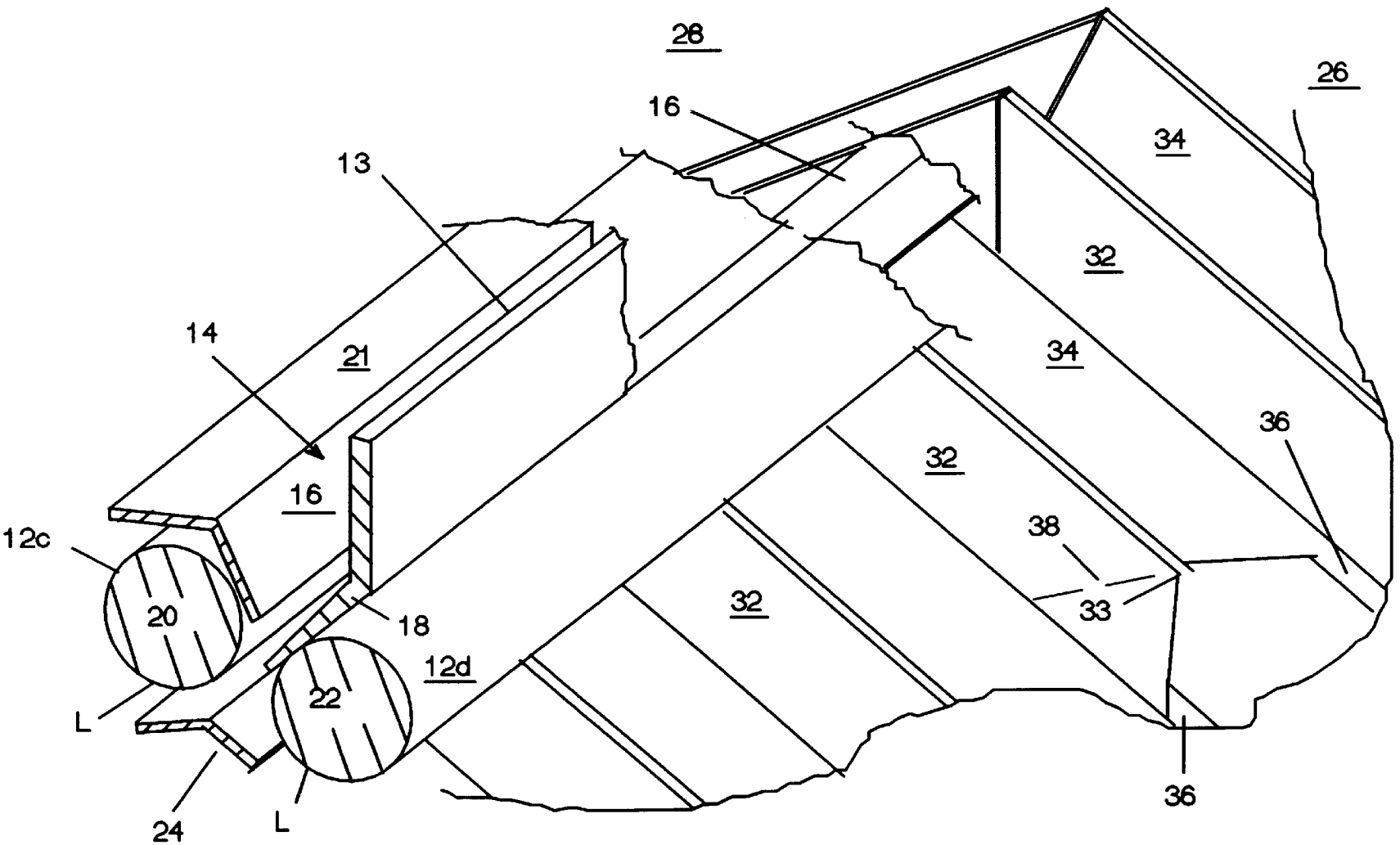
FIG. 2 is a broken pictorial view of a coin feed portion of the sorter shown in FIG. 1 particularly illustrating how coins are fed from a hopper into two sets of a plurality of trough-like channels.

Referring now to FIG. 2, each long edge of slot 14 may be provided with a downwardly extending lips 13 and 18, respectively, for funneling coins downward. Rods 20 and 22, or other similar structure, may be positioned behind and below lips 13 and 18 and serve to spread out the flow of coins between their lower sides L and upper surfaces of an inverted v-shaped plate 24. The coins may move in both directions along plate 24 left or right into two sets of troughs 26 and 28 (FIG. 1), or a single set of troughs 30 may be used as shown in FIG. 4. While any number of troughs may be employed, 8 troughs along one side of the sorter allows construction of a sorter of convenient size and capacity.

As shown in FIG. 2, each of these troughs, hereinafter referred to as troughs 30, is longitudinally bisected by a separator 32 extending from just under hopper 10 downward. Initially, the separators may be fairly thin and then transition at about point 33 further down the troughs to a wider dimension that generally fills the region between side walls 34 of the troughs, leaving a relatively narrow space 36 between the wider separators and side walls 34. This forces the stream of coins flowing down the troughs into generally single-file relation on each side wall 34 of the troughs. Alternately, the separators may be configured without the upper thin region under hopper 10, the separators beginning at about point 33 and configured as a wedge as shown by dashed lines 38. As such, coins falling through slot 14 are divided in each trough into 2 flows of coins moving along each of side walls 34. When the flow of coins encounters the transition beginning at 33, the coins are forced into generally single file relation, although coins may still be riding one atop another in upper-portions of narrow regions 36.

Figure 3:
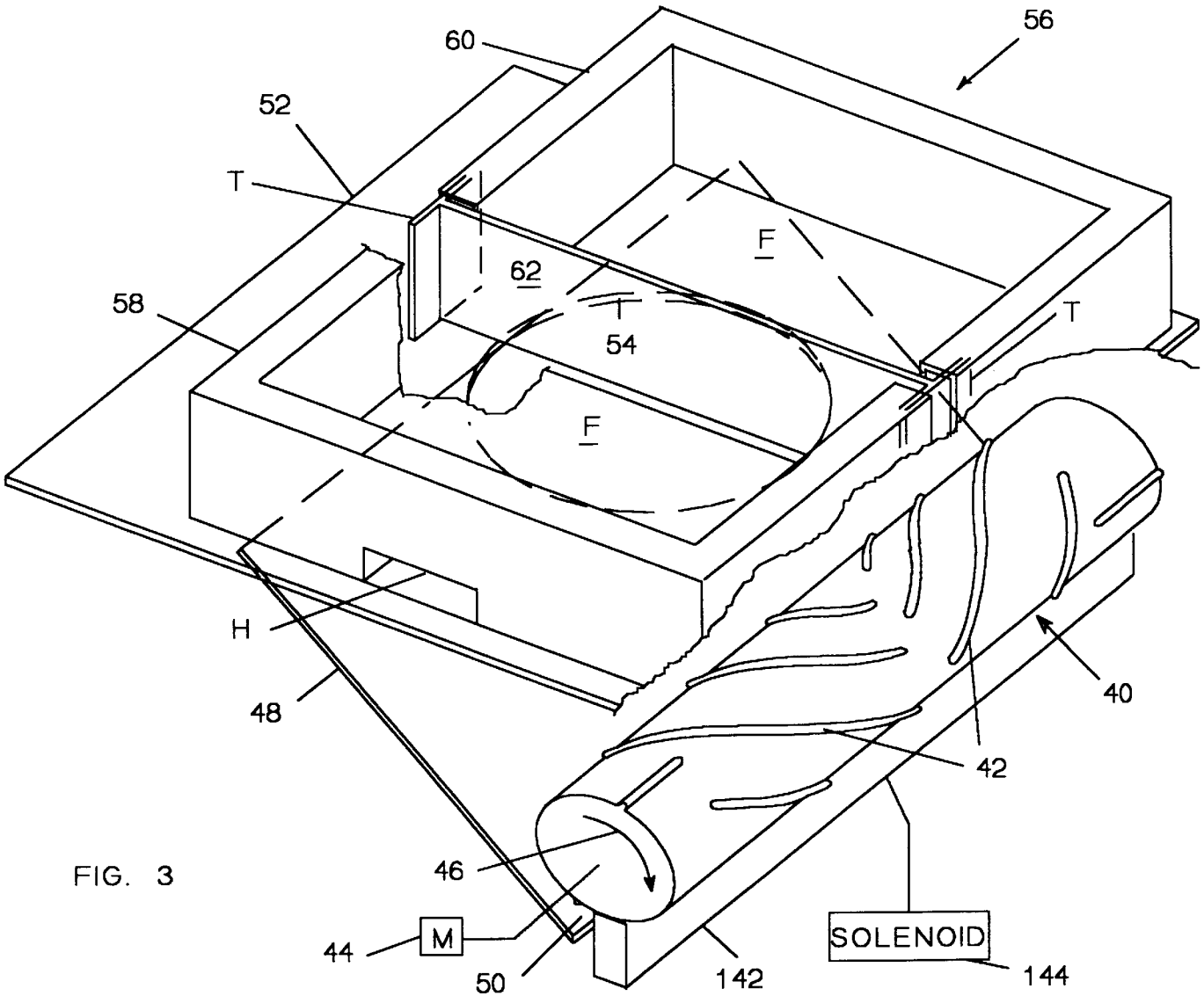
FIG. 3 is a pictorial diagrammatic view of one feed system of the invention.

In another embodiment of a coin feeding system, FIG. 3 shows apparatus that may be used to feed coins to the sorter. Here, an elongated roll 40 having spiral ridges 42 thereon is rotated at a relatively slow speed, which may be about 60 RPM or so, by a motor drive assembly 44. Significantly, roll 40 may be rotated against the flow of coin, as shown by arrow 46 so that spiral ridges 42 appear to move outward along the rotating roll. A plate 48 is positioned at a relatively steep angle, which may be from about 20–45 degrees or so from the horizontal, with a forward edge 50 of the plate being generally underneath roll 40 and spaced therefrom about ⅛ inch to ¾ inch or so. Ridges or a lip may be provided along sides of plate 48 to prevent coins from escaping along side edges of plate 48. With this construction, a bulk quantity of coins falling on plate 48 slide downward toward the center of roll 40 and are distributed outward from the center of roll 40 by ridges 42, after which the coins pass underneath roll 40 into troughs of the sorter. A second plate 52 having an opening 54 therein may be mounted above plate 48 and to the rear of roll 40, and may form the bottom of a hopper, or a coin-holding hopper 56 may be mounted in pivotable relation with respect to plate 52 so as to dump coins through opening 54 when pivoted. Here, hopper 56 may be constructed of hopper halves 58 and 60 each having a floor F generally covering opening 54. A separator 62 extends across the center of opening 54, and is provided as shown with T-shaped ends T (partially shown in dashed lines). The side ends of hopper halves 58 and 60 are hollow, and fit over respective T-shaped portions of separator S. A handhold or grip region H is provided in ends of hopper halves 58 and 60 so that each of the halves may be conveniently pivoted upward. With this construction, mixed denomination of coins may be emptied into both halves 58 and 60, after which the operator pivots one of halves 58 and 60 upward, emptying coins therein through a respective half of opening 54. The other half of the hopper is then emptied in the same manner. Alternately, any method for applying a bulk quantity of coins onto plate 48 so that they slide generally toward the center of roll 40 may be used.

Figure 4A:
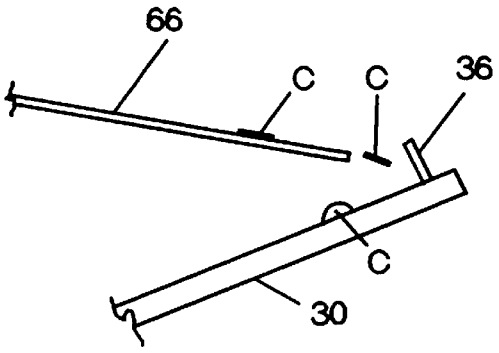
FIG. 4*a* is a diagrammatic illustration of particulars of the feed system of the embodiment shown in FIG. 4.
Figure 4:
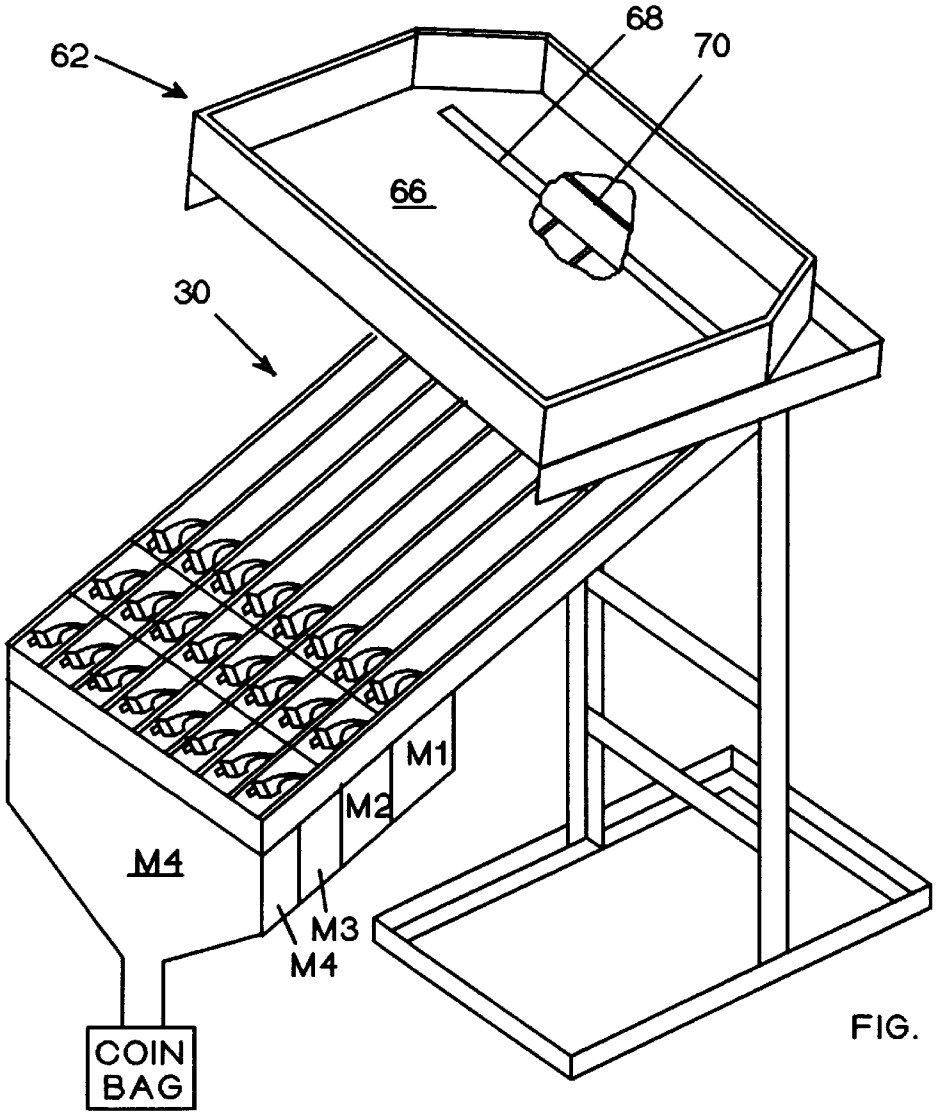
FIG. 4 is a pictorial, diagrammatic illustration of a second embodiment of the invention wherein troughs that separate coins into single layers and single files proceed only in one direction, and which further shows a different coin feed system.

Another embodiment of a coin feed system is illustrated in FIGS. 4 and 4*a*. Here, a hopper 62 is provided with a pivoting portion 64, which may be pivoted upwardly about a pivot point P. This causes coins deposited on surface 66 to slide toward a slot 68, which may or may not be provided with an upwardly extending baffle (not shown) as described above, the coins falling through slot 68 and striking a baffle 70. Baffle 70 causes coins C to lose some of their forward momentum and then move downward into troughs 30 to be processed as will be further explained.

Figure 5A:
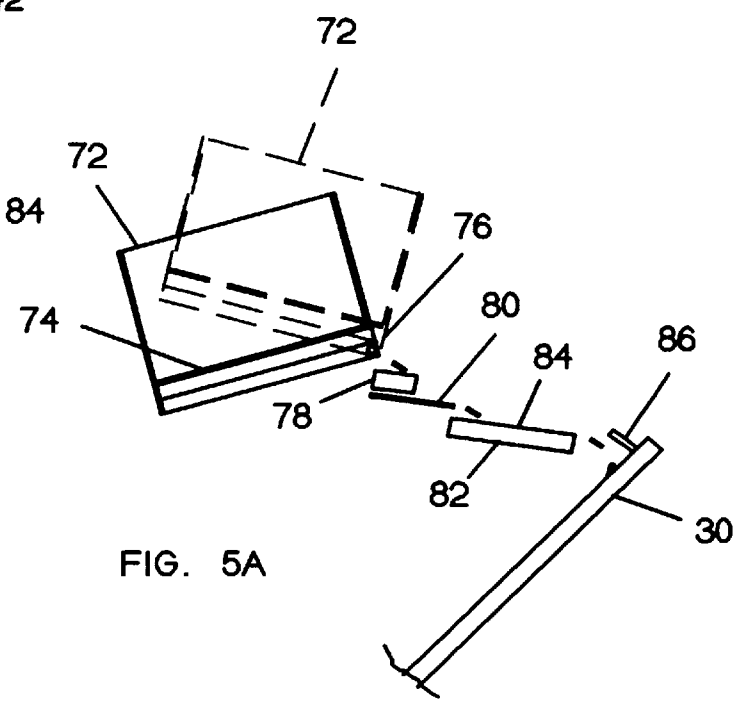
FIG. 5*a* is a diagrammatic illustration of particulars of construction of the embodiment of FIG. 5.
Figure 5:
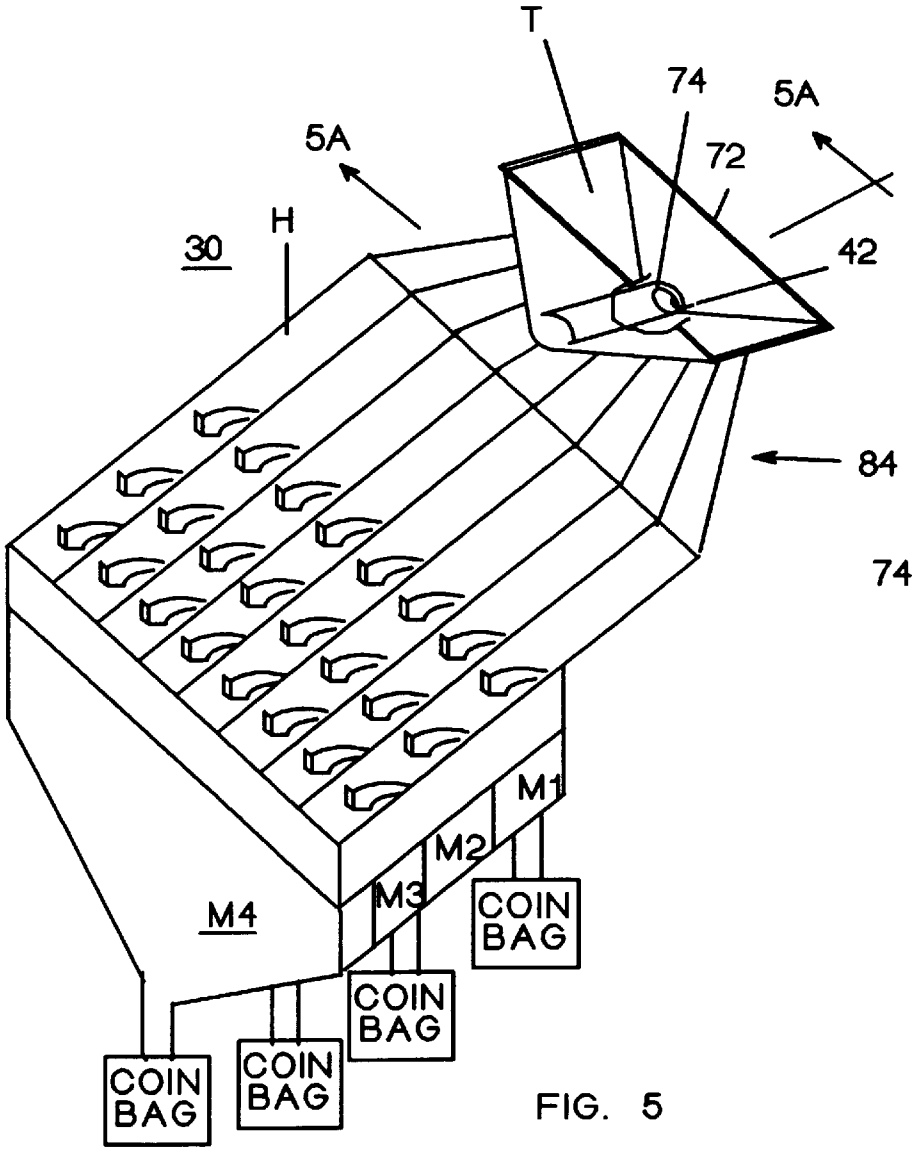
FIG. 5 illustrates still another feed system for feeding of coins to troughs.

Yet another embodiment of a coin feed system is shown in FIGS. 5 and 5*a*. In this embodiment, coins are moved over a number of surfaces to spread them out before finally reaching a one of troughs 30. As such, coins are first placed in a pivotable hopper 72, which is provided with a baffle 74 supported in spaced relation (by means not shown) above tapered surfaces T of the hopper, whereby coins resting on baffle 74 do not press on coins that are sliding between baffle 74 and the tapered surfaces of hopper 72, making the arrangement less susceptible to jamming. An opening 76 is provided underneath baffle 74 in a lower side of hopper 72 so that as hopper 72 is pivoted upward, as shown by the dashed line position of hopper 72 in FIG. 5*a*, coins slide from beneath baffle 74 through opening 76. From opening 76, the coins strike a curved plate 78, which spreads out the coins sideways with respect to the flow of coins, after which the coins fall onto a flat plate 80. From plate 80 the coins are further distributed outward to troughs 30 by a fan-shaped plate 82. Plate 82 is provided with accordion-like pleats into which the coins fall, and is further configured having a relatively narrow end that receives the coins, after which the coins are distributed outward to a wide end by diverging paths of the pleats. Significantly, size and shape of the V-shaped pleats matches configuration of troughs 30. If desired, a vibrating mechanism may be attached to any or all of plates 78, 80 and 82 to facilitate coin movement. Alternately, a single plate coupled to a vibrator unit may be used to spread out the coins and deliver them to troughs 30. Further yet, such a plate may form the floor of a coin receiving hopper, and either be tilted by an operator or mounted in an inclined position to spread out and deliver coins to troughs 30.

Figures 6, 6A, 6B, 6C:
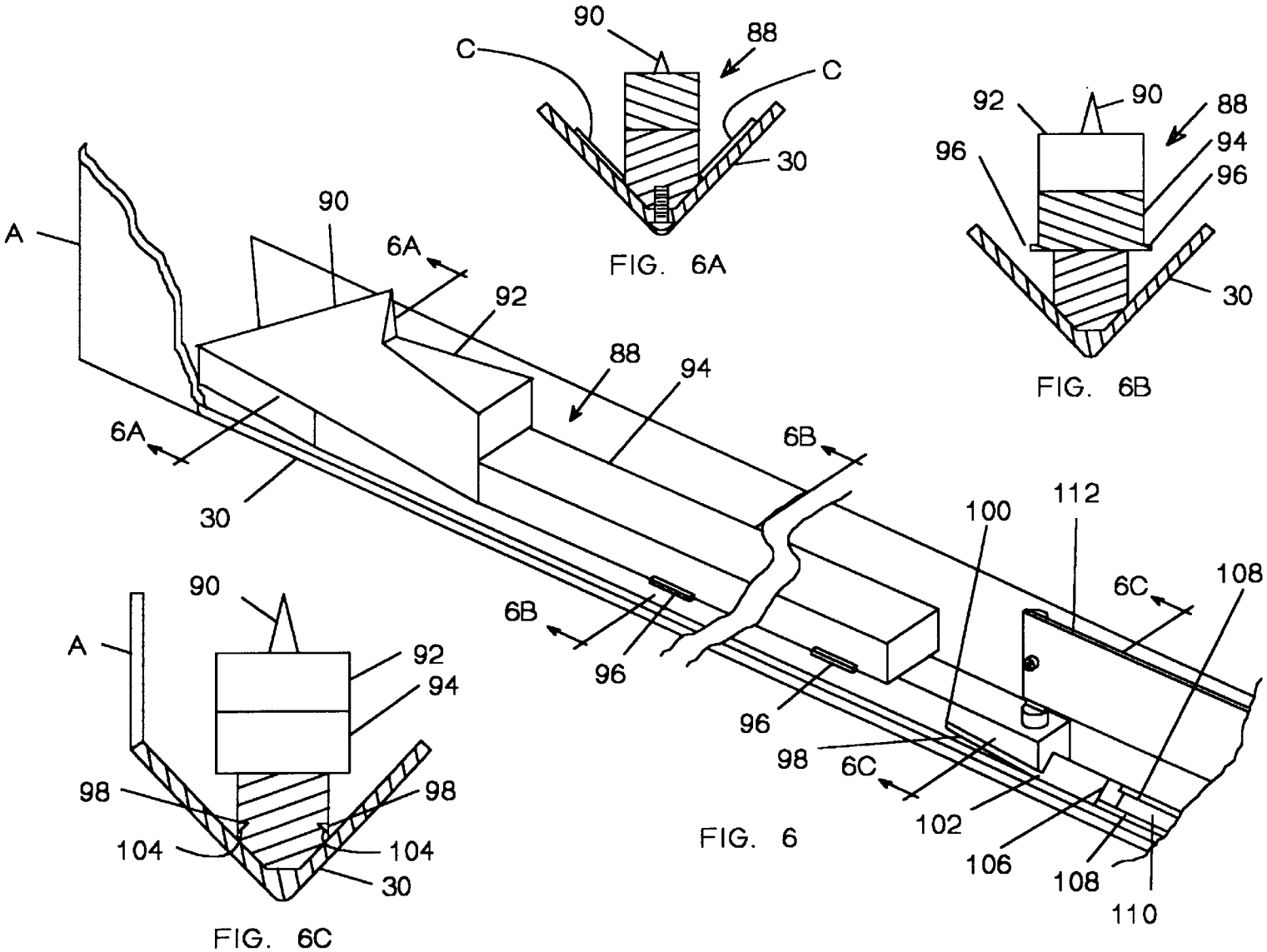
FIG. 6 illustrates a separator assembly of the present invention.
FIG. 6*a*, 6*b*, and 6*c* are sectional views taken along lines 6*a*—6*a*, 6*b*—6*b*, and 6*c*—6*c*, respectively.

Referring now to FIGS. 6, 6*a*, 6*b*, and 6*c*, one example of configuration of an upper region of one of troughs 30 wherein coins are forced into single file flow is shown. Here, a separator assembly 88 is shown mounted in trough 30. Initially, a portion of the flow of coins from any of the coin feeding systems or combinations thereof described above is directed by separator edge 90 of upper separator 92 onto sides of trough 30. As shown in FIG. 6*a*, separator assembly 88 just below upper separator 92 is of a width so as to generally fill the central region of trough 30. Sides of trough 30 may be about 90 degrees with respect to each other, meaning that coins travel down sides of the trough in a 45 degree groove formed between sides of separator assembly 88 and sides of trough 30, as shown by coins C. As the coins travel down trough 30, shingled coins, i.e. coins that are one atop another, are separated by virtue of the upper coin riding over the lower coin. This effect may be due to a combination of friction between the lower coin and inner walls of the trough and a slight wedging effect of the lower coin in the groove formed between the side walls of trough 30 and the vertical walls of separator assembly 88. In any case, the upper coin slides off the lower coin, separating the shingled coins.

Further down the trough, as shown in FIG. 6*b*, an upper portion 94 of separator assembly 88 is widened, generally filling the upper region of trough 30. This widened region further assists in forcing coins into single file relation. Small protrubances 96 (FIG. 6) configured generally as shown may be positioned along lower sides of the widened portion of separator assembly 88, these protuberances serving to separate coins that are riding one atop another in a jammed configuration, such as where two coins moving along walls of trough 30 hold a third coin against the vertical walls of separator assembly 88. In this instance, protrubances 96 hold back or otherwise interfere with movement of the upper coin, allowing the lower coins to slide from beneath the upper coin.

Figures 9, 9A:
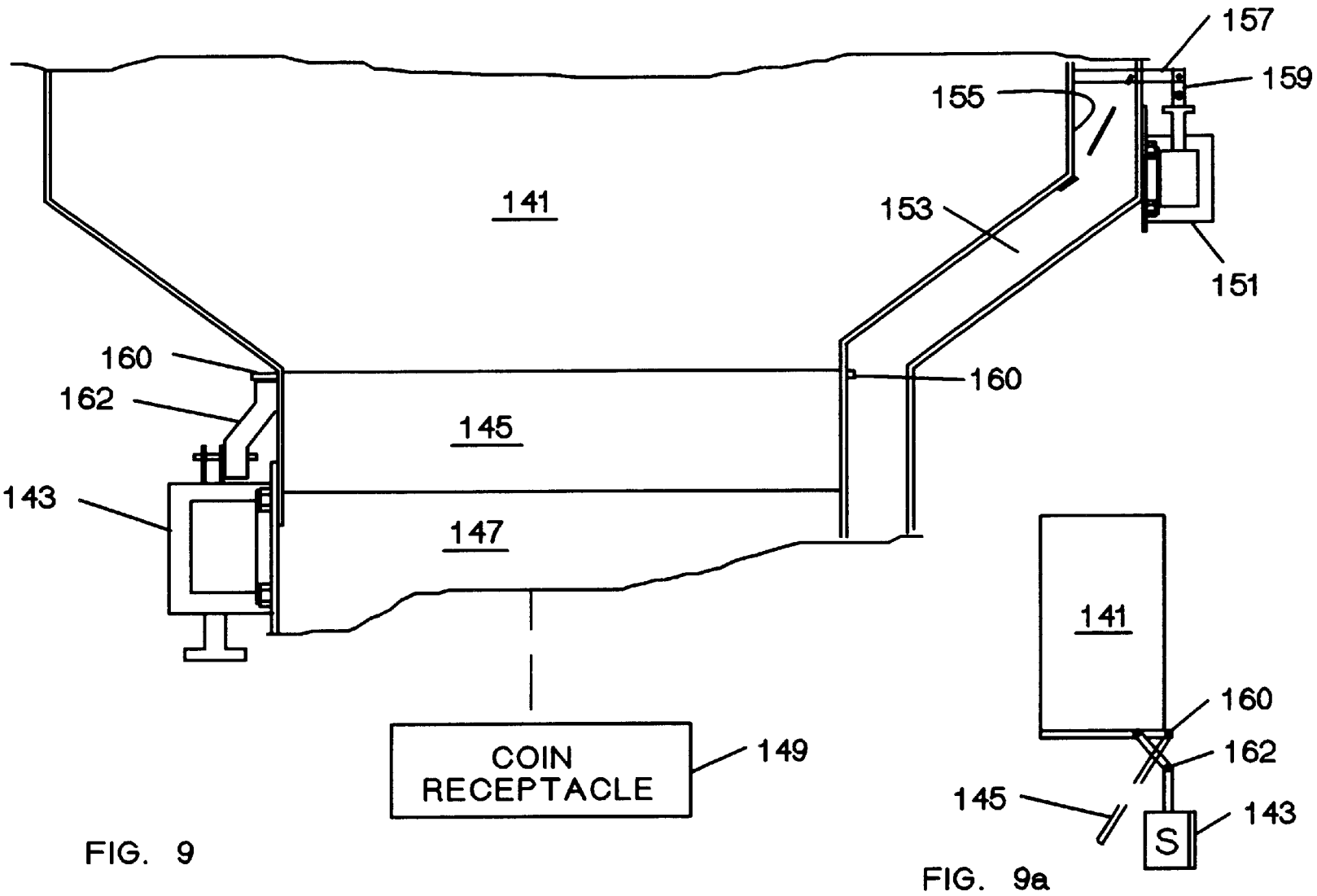
FIG. 9 is a diagrammatic view of another embodiment of the invention.
FIG. 9*a* is an end view of the embodiment of FIG. 9 showing particular details thereof.

Still further down trough 30, and as shown in FIG. 6*c*, a groove 98 is provided in a lower portion of separator assembly 88, groove 98 beginning at a point 100 (FIG. 6) elevated from sides of trough 30 and angled downward so that groove 98 terminates at point 102 at a respective wall of trough 30. Also at point 102, the walls of the lower portion of separator assembly 88 transition from being 45 degrees with respect to sides of trough 30 to 90 degrees with respect to trough 30. Groove 98 is provided with a lower inner wall 104 having about a 90 degree angle with an adjacent wall of trough 30. With this configuration, groove 98 prevents coins from bouncing, and subsequently being missorted, as they encounter the transition at point 102 from a vertical wall of separator assembly 88 to a wall that is at about a 90 degree angle with respect to the side of trough 30. The angled walls of separator assembly 88 end at point 106, where the angled walls meet lips or ridges 108 along which the coins continue to ride to the diverters, with a slot 110 being defined between ridges 108. Coins fall through slot 110 as they are sorted, as will be further explained. Also shown in FIG. 6 (and in FIG. 9) in dashed lines is a vertical wall a extending from an upper edge of trough 30. This vertical wall may be placed on one side of trough 30 so that when several troughs are positioned together, each trough is enclosed along a side by a wall as shown in FIG. 9. These walls prevent coins from jumping from one trough to another during operation.

Figure 7A:
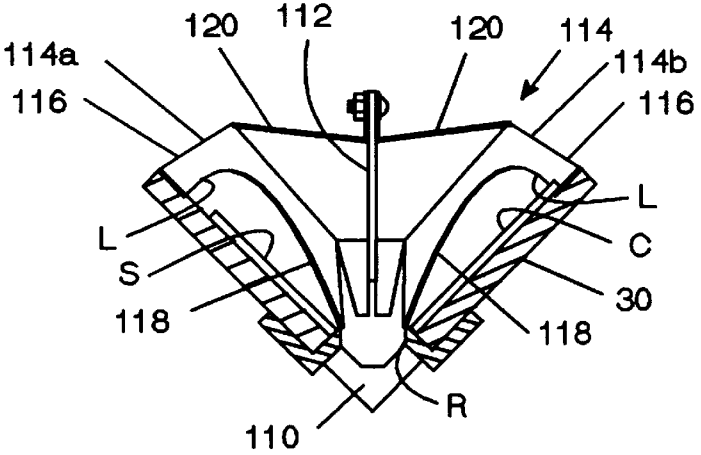
FIG. 7*a* is a sectional view taken along lines 7*a*—7*a* of FIG. 7.
Figure 7:
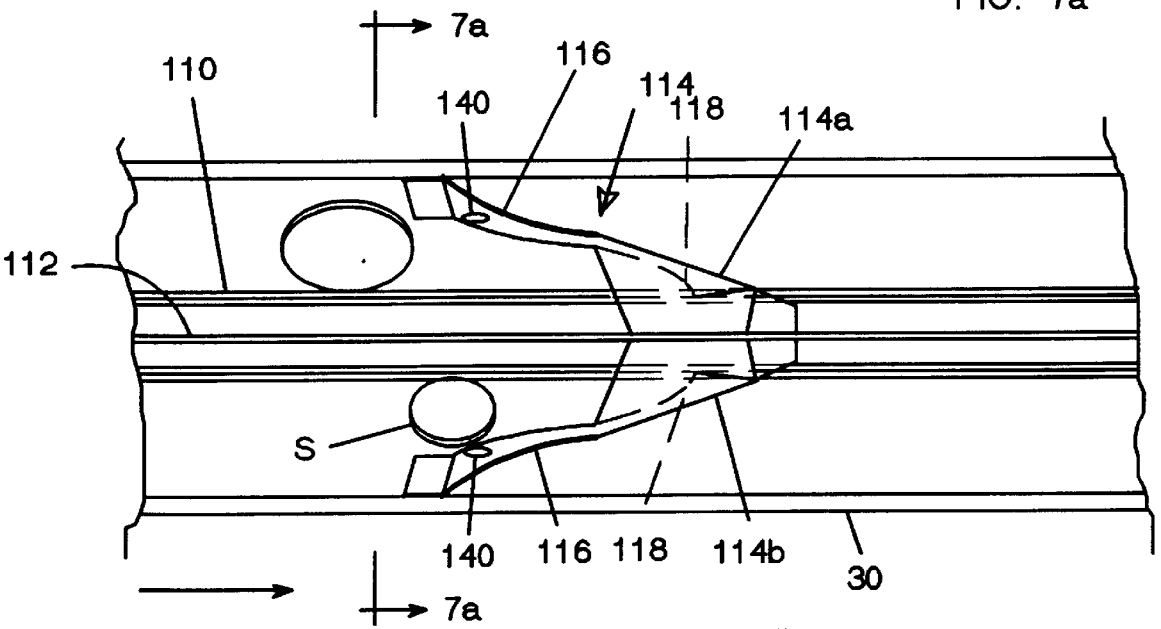
FIG. 7 is an illustration of a diverter arrangement which causes coins of one diameter to be diverted through a slot or opening in a trough.

A mounting strip 112 is supported at one end by separator assembly 88, this mounting strip supporting opposed pairs of diverters, one of which being shown in FIGS. 7 and 7*a*.

As shown in FIG. 1, 8 downwardly extending troughs on each side of hopper 10 are illustrated, and FIGS. 4 and 5 show one set of 8 troughs extending from one side of their respective hoppers. Thus, with separator assemblies 88 in each trough, there are 16 channels of coin flow down each set of troughs. In each channel of flow, there is one diverter for each diameter of coin. Larger diameters of coin are sorted first, with the smallest diameter of coin not requiring any active sorting, as the smallest diameter coins are the only diameter remaining after the larger diameters of coin are sorted. Thus, coins of the smallest diameter simply flow past diverters for larger coins and are directed into a holding container or region, as will be discussed. Where there is a possibility that smaller coins inadvertently become mixed in with larger tokens such as found in gaming establishments, diverters may be positioned to sort the desired tokens or coins while allowing smaller coins or tokens to flow past the diverters and become separated from the larger tokens or coins. It is noted one of the troughs is configured as a half trough to allow a flow of coins along only one side of the trough. A single diverter for each diameter of coin to be sorted is positioned in this trough, also as will be further explained.

As shown in FIGS. 7 and 7*a*, a pair of diverters 114 are mounted to mounting strip 112 for sorting each diameter of coin. Slots 110 in the bottom of troughs 30 extend underneath the diverters generally as shown from point 106 of separator assembly 88 (FIG. 6) to a point past the last pair of diverters where the smallest coins simply fall through slots 30 into a holding receptacle. Alternately, instead of a slot common to all diverters, a discrete opening may be provided underneath each diverter for sorted coins to fall through. Slots 110, as shown in FIGS. 7 and 7*a* is configured having a ridge R along upper sides of the slot for supporting a lower edge of coins riding along walls of troughs 30. To cause the smallest coins to fall through slots 110, ridge R may be eliminated at a point where it is desired to cause the smallest coins to fall through slot 110.

Each diverter 114*a* and 114*b* is constructed having an engagement arm 116, which may be attached to an upper inner side of a respective wall of trough 30, or may simply be held thereagainst by spring tension. If necessary, a recessed region may be provided in the walls to accommodate the thickness of arms 116 where they contact the walls so as to not present an impediment to coin travel. As shown in FIG. 7*a*, a dimension between a lower edge L of each diverter and a respective ridge R the coin is riding on is selected so that the upper edge of a coin of a particular diameter to be sorted engages arm 116, as shown by coin C in FIG. 7*a*. This urges the upper edge of the trough wall toward mounting strip 112. As a coin rides along arm 116, the coin engages a downwardly extending region 118 of the diverter, disengaging the coin from ridge R and moving it toward slot 110. A top 120 of each diverter is configured with a slope downward from arms 116, so that just after the lower edge of a sorted coin is disengaged from ridge R, the coin strikes top T of the diverter, which positively deflects the coin through slot 110. Coins that are smaller in diameter than the dimension between lower edge L of a diverter and ridge R simply move past that diverter unaffected, as shown by coin S in FIGS. 7 and 7*a*.

Coins deflected through slot 110 by the diverters fall directly into a manifold for containing that particular denomination of coin, with 4 manifolds, and thus four denominations of coins, being shown in this example. Of course, a greater or lessor numbers of diameters, and thus denominations, of coins may be sorted by adding or subtracting appropriately configured or located diverters to each flow of coins. Also, sorted coins may be directed into a coin bag or other holding receptacle rather than a coin manifold.

Figure 8:
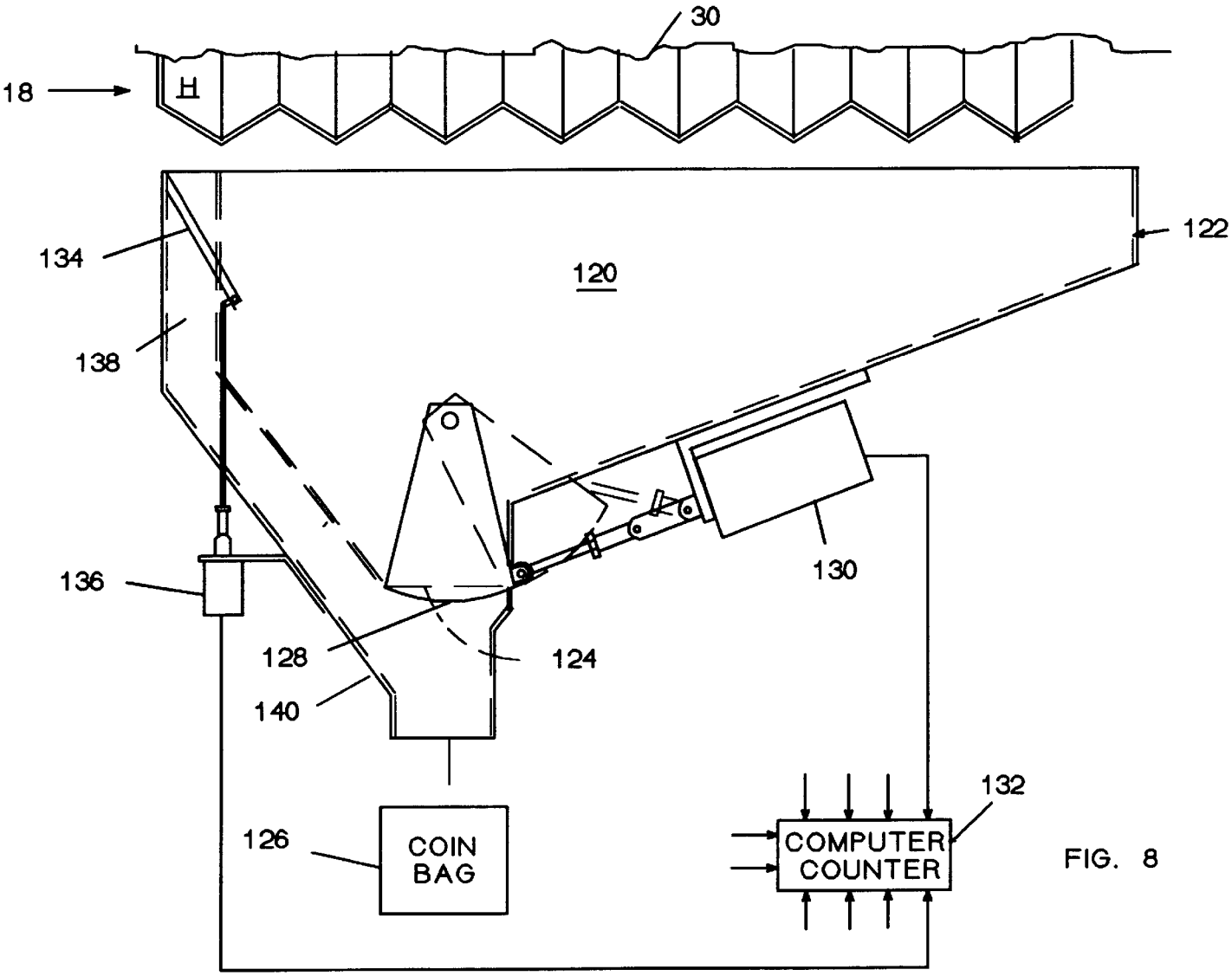
FIG. 8 is a diagrammatic view of one of four coin receiving manifolds, one for each diameter of coin.

FIG. 8 illustrates one example of a coin manifolds, manifold 120, with troughs 30 diagrammatically illustrated thereabove. An upper region 122 of the manifold extends under all troughs 30, including half-trough H, such that coins from all diverters for that diameter are directed through slots 110 into manifold 120. Lower walls of the manifold are tapered as shown toward an opening 124, which may be conventionally provided with a coin bag holder (not shown), which in turn supports a coin bag 126. Tapered as shown, coins falling from the diverters slide toward opening 124, where they fall into coin bag 126. A first gate 128 operated by a solenoid 130 under control of a computer-counter 132 is movable from the position shown wherein opening 124 is blocked, retaining coins in manifold 120, to a normally open position illustrated by dashed lines wherein coins are allowed to fall into bag 126. A second gate 134 operated by a solenoid 136 under control of computer-counter 132 is positioned to control flow of coins from half trough H on one side of troughs 30, in this case on the left hand side. A channel 138 is either opened or closed at an upper region by second gate 134, channel 138 extending downward to a point 140 which bypasses first gate 128. With this construction, and with second gate 134 in the open, dashed line position, sorted and counted coins falling into channel 138 from trough H are directed past first gate 128 and into bag 126. With second gate 134 in the closed position as shown, channel 138 is closed and coins from trough H are directed into manifold 120.

Another embodiment of a coin receiving manifold is shown in FIG. 9. Here, a manifold 141 is shown as being wider than manifold 120, meaning that coins are not required to slide as far along an inclined surface. As described above, coins are sorted at coin sorting region 30, and fall into manifold 141. A first solenoid 143 operates a flap-type valve 145 to either open or close an opening 147, this opening communicating with a coin bag or receptacle 149. A second solenoid 151 is operable to either open or close a trickle flow channel 153 for "topping off" a bag or other receptacle where an exact count of coins is to be deposited into bag or receptacle 149. In this embodiment, a portion 155 of a wall of trickle flow channel 153 may be constructed of a flexible material, such as spring steel, with this portion being pulled to contact the opposite side of the channel, as shown in dashed lines, to effect closure thereof when solenoid 151 is actuated. Alternately, portion 155 may be hinged. As such, solenoid linkage 157 is fixed to portion 155, while linkage 159 is pivotally coupled at each end to linkage 157 and the solenoid arm. As described above, when this occurs, coins flowing through the trickle channel are routed back into manifold 141.

Flap valve 145 is pivotable about pins or the like 160, with a solenoid link 162 positioned as shown in FIG. 9*a*. As described above, when solenoid 141 is actuated, valve 145 swings down to about the dashed line position shown in FIG. 9*a*, allowing coins to flow into bag or receptacle 149.

Computer-counter 132 receives inputs from coin sensors 140 (FIG. 7), which may be mounted to arms 116 proximate a point where a coin contacts arms 116. Sensors 140 may be proximity sensors, optical sensors, or contact sensors positioned as would be appropriate for a particular type sensor, and provide electrical signals to computer-counter 132 responsive to sorted coins passing across arms 116. Alternately, coin sensors 140 may be mounted in walls of the troughs in front of and after diverters 114*a* and 114*b*, with computer-counter 132 performing a subtraction of the number of coins passing a sensor positioned after a diverter from the number of coins passing a sensor positioned in front of the diverter in order to ascertain the number of coins sorted by that diverter. Coin sensors may also be mounted in walls of the trough after the last diverter in order to sense quantity of the smallest diameter denomination of coin, which as stated pass through all other diverters unaffected.

Computer-counter 132 may be configured or otherwise provided with a program that operates normally-open gates 128 and 134 in a manner such that a bag or other holding receptacle 126 for holding a specified number of coins, such as 1,000 coins, is filled with a number of coins from opening 124 and channel 138 just short of the specified number of coins, such as 970 coins where the bag is to be filled with 1,000 coins. At that point, first gate 128 is operated to the closed position shown, retaining sorted coins in the respective manifold. Concurrently, an indicator signal is provided to the operator indicating that the bag is almost full so that the operator may slow the flow of coins and terminate the flow when the bag is full in order to change the bag. The second gate 134 remains open, allowing a trickle flow of coins from trough H through channel 138 to finish filling the bag with exactly 1,000 coins. When the last, 1,000th coin from trough H is counted, second gate 134 is closed after a delay sufficient for the last coin to fall past gate 134, causing the flow of subsequent coins from trough H to be routed into the manifold. With closing of second gate 134, a second indicator signal is provided to alert the operator to the fact that the bag is full so that the flow of coins may be terminated and the bag changed. In the instance where the flow of coins to the sorter is to be terminated automatically, the indicator signal indicating that a bag is full may be used to close a gate positioned to block the flow of coins from the hopper into which coins are placed by an operator. This is diagrammatically shown in FIG. 3 by a gate 142 under roll 40, gate 142 operated up or down, as by a solenoid 144, to block or enable a flow of coins from under roll 40.

Other embodiments include one wherein a different number of troughs than the number disclosed above may be used. Also, the coin bags may be filled from the manifolds to any number short of the number designated for a full bag or other receptacle, such as 990 for a bag of 1,000, with the remaining coins to fill the bag obtained from half-trough H. Further, instead of a half-trough to accomplish the trickle flow, a full trough or more than one trough may be used to provide the trickle flow to finish filling a bag or other coin holding receptacle.

In operation, an operator places coins to be sorted in a one of the disclosed hoppers, and causes the coins to fall onto troughs 30 where they slide toward the diverters as described. In FIG. 1 the sorted coins may or may not be counted, and fall into rectangular coin holding receptacles 15. In FIGS. 4 and 5, the sorted coins fall into manifolds M1–M4 and then into a coin bag or other receptacle. When a bag in this embodiment reaches a count near the designated full count, the first gate 128 closes opening 124, allowing a trickle flow through channel 138 to finish filling the bag and providing a signal notifying the operator that the bag is nearly full. When the last coin is counted, second gate 134 is closed, routing the trickle flow of coins back into manifold 120 and notifying the operator that the bag is full.

From the foregoing, it is believed that there has been described a new and improved coin sorter. Having thus described our invention, we claim:

1. A sorter for sorting coin-like objects as a function of diameter comprising:

a. a plurality of elongated, side-by-side, V-shaped troughs, each formed of a pair of side walls;

b. said side-by-side troughs being positioned on a slope, having an upper end region and a lower end region;

c. an elongated divider in each said trough between a pair of said walls and generally bisecting said pair of walls to form two object paths with an edge of a said object riding along a said divider and a face of said object riding along a said wall, wherein layered said objects tend to separate;

d. an object separator in said upper region, including tapered surfaces urging said objects toward one or the other of said walls;

e. said troughs in said lower region of said troughs transitioning to include a discrete lower edge object support of a discrete length adjoining each said wall; and f. a series of object diverters arranged coextensive with said object support, each diverter of a said series having an upper object engaging region which engages an upper region of a said object and diverts and removes it from a said object support and wall, and a said region of a said diverter of a said series of diverters being progressively closer to a said object support as a direct function of object travel on a said object support.

2. A sorter as set forth in claim 1 wherein there is an opening between said object supports, and being betweeen opposite walls of a said trough, through which diverted coins pass downward.

3. A sorter as set forth in claim 2, wherein there is a plurality of said plurality of said troughs.

4. A sorter as set forth in claim 3 including a plurality of receptacles, each being configured and positioned to receive objects from selected said openings passing only one diameter of object, and being from a plurality of said plurality of troughs.

5. A sorter as set forth in claim 4 wherein a said receptacle comprises:

a. an upper object receiving region;

b. a lower region;

c. said upper region of a selected said receptacle coupled to receive objects from a plurality of said selected openings, each of said selected openings passing objects of a selected one diameter;

d. a first electrically operated valve responsive to a first electrical signal for coupling object flow from at least one of said openings providing objects of a said selected one diameter to said upper region of said receptacle and responsive to a second electrical signal for coupling said objects of said one diameter to, and including, a selected sorter exit;

e. a second electrically-operated valve having an input for receiving objects from said lower region of said receptacle and responsive to a third electrical signal for maintaining said second electrically operated valve closed and responsive to a forth electrical signal for operating said second electrically-operated valve open, enabling objects to exit said receptacle and said sorter;

f. a plurality of sensors positioned to sense and provide a discrete electrical state each time a said object is diverted and thus there is provided a count electrical state each time an object of a particular, said one, diameter is diverted;

g. computational means responsive to the occurrence of a selected number of said count electrical states from selected said sensors, arising out of a selected number of occurrence of diversion of objects of a particular, said one, diameter, for providing said first, second, third, and forth electrical signals to a discrete said electrically operated valve, being of a selected one of said electrically operated valves of a said receptacle.

6. A sorter as set forth in claim 1 further comprising a generally vertical side-wall extending from an upper edge of a said wall of a said trough, wherein objects are prevented from jumping from one trough to another.

7. A sorter as set forth in claim 1 wherein said sorter includes an object feeder which in turn includes;

a. a generally planar surface receiving said objects and generally extending to, and including, a feeder exit; and b. an object spreader proximate to said planar surface and from which spread coins are fed to said feeder exit and then to, and across, said upper region of said troughs.

8. A sorter as set forth in claim 7 wherein said object feeder includes a hopper into which said objects are placed and wherefrom said objects are supplied to said generally planar surface.

9. A sorter as set forth in claim 7 wherein said object spreader is a spreader which spreads said objects generally transverse to the direction of progress of an object to said feeder exit, and wherefrom said objects flow to all of said upper regions of said plurality of said plurality of side-by-side troughs.

10. A sorter as set forth in claim 7 wherein said spreader includes a reduced in thickness object passageway through which said objects progress, and wherein and whereby layering of objects is reduced.

11. A sorter as set forth in claim 7 wherein said object spreader includes a vibrational drive connected to said planar surface and applying a vibrational force on said planer surface.

12. A sorter as set forth in claim 11 wherein said direction of vibrational force is normal to the general direction of movement of said object progress to exit.

13. A object sorter as set forth in claim 7 wherein said spreader includes an obstructive member positioned above said objects on said planar surface and engages any upper layer of said objects wherein objects are generally reduced to a single layer of objects.

14. A sorter as set forth in claim 13 wherein said obstructive member is a rotary assembly including a rotating surface and wherein said rotating surface rotates in a direction opposing the direction of movement of said objects toward said exit.

15. A sorter as set forth in claim 1 including an elongated member positioned above said upper regions of said side-by-side troughs.

16. A sorter as set forth in claim 15 wherein said elongated member is a generally cylindrical member.

17. An object sorter as set forth in claim 16 wherein there is a second elongated said cylindrical member coextensive with said elongated cylindrical member and said objects move between said cylindrical members.

18. An object sorter as set forth in claim 17 wherein said objects are directly engaged with at least one of said cylindrical members.

19. A sorter for sorting coin-like objects as a function of diameter comprising:

a. a plurality of elongated pairs of oppositely, and complimentarily sloped walls, at a first slope, each said wall having at least a region of wall at a discrete space from the other said wall, and said plurality of elongated pairs of walls, being positioned on a second slope, generally normal to the direction of slope of said first slope;

b. a object path divider, having two generally vertical, horizonally spaced, surfaces, each said surface closely intersecting with a said wall in a lower region of a said wall, wherein a first coin-like object, having a face resting on one said wall, will also have an edge resting against one of said surfaces, whereby if there is a second coin-like object positioned upon said first coin-like object, the second said object will advance, to move in front of said first coin-like object to effect object separation as the objects advance downward, along said second slope;

c. a said wall in a lower region of said second slope of said plurality of elongated pairs of walls accompanied by a discrete lower edge object support of a discrete length adjoining each said wall; and d. a series of object diverters arranged coextensive with said object support, each diverter of a said series having an upper object engaging region which engages an upper region of a said object and diverts and removes it from a said object support and wall, and a said region of a said diverter of a said series of diverters being progressively closer to a said object support as direct function of object travel on a said object support.

* * * * *